US010259109B2

(12) United States Patent
Vertanen

(10) Patent No.: US 10,259,109 B2
(45) Date of Patent: Apr. 16, 2019

(54) LOCKING TERMINAL CLAMP CABLE ASSEMBLY

(71) Applicant: Vertanen Industries, Inc., Cary, IL (US)

(72) Inventor: Michael J. Vertanen, Edgerton, WI (US)

(73) Assignee: Genesis 12, Inc., Edgerton, WI (US)

( * ) Notice: Subject to any disclaimer, the term of this patent is extended or adjusted under 35 U.S.C. 154(b) by 0 days.

(21) Appl. No.: 15/584,720

(22) Filed: May 2, 2017

(65) Prior Publication Data

US 2018/0079061 A1 Mar. 22, 2018

Related U.S. Application Data

(60) Provisional application No. 62/331,532, filed on May 4, 2016.

(51) Int. Cl.

| | |
|---|---|
| ***H01R 11/00*** | (2006.01) |
| ***B25B 7/12*** | (2006.01) |
| ***B25B 27/14*** | (2006.01) |
| ***B25B 7/04*** | (2006.01) |
| ***H01R 11/24*** | (2006.01) |
| ***B25B 7/16*** | (2006.01) |
| ***B25B 7/22*** | (2006.01) |
| ***H01R 11/28*** | (2006.01) |

(52) U.S. Cl.

CPC ..... *B25B 27/146* (2013.01); *B25B 7/04* (2013.01); *B25B 7/123* (2013.01); *B25B 7/16* (2013.01); *B25B 7/22* (2013.01); *H01R 11/24* (2013.01); *H01R 11/281* (2013.01); *H01R 2201/26* (2013.01)

(58) Field of Classification Search

CPC ..... H01R 11/24; H01R 11/282; H01R 13/15; H01R 11/28; H01R 2201/26; H01R 23/10; H01R 24/76; B25B 27/146; B25B 7/04; B25B 7/16

USPC ..... 439/504, 822, 92; 81/370, 374

See application file for complete search history.

(56) References Cited

U.S. PATENT DOCUMENTS

| | | | | |
|---|---|---|---|---|
| 1,951,591 | A * | 3/1934 | Anzalone | H01R 11/284 429/121 |
| 3,413,593 | A * | 11/1968 | Schaefer | H01M 2/06 439/217 |
| 6,796,841 | B1 * | 9/2004 | Cheng | H01R 11/24 439/506 |
| 6,871,387 | B2 * | 3/2005 | Cheng | H01R 11/24 24/499 |
| 6,899,552 | B1 * | 5/2005 | Robinson | H01R 11/24 439/133 |
| 9,492,911 | B2 * | 11/2016 | Hyma | B25B 7/123 |
| 2002/0157507 | A1 * | 10/2002 | Chou | B25B 7/123 81/367 |

* cited by examiner

*Primary Examiner* — Xuong Chung Trans
(74) *Attorney, Agent, or Firm* — Perkins Coie LLP

(57) ABSTRACT

A locking terminal clamp cable assembly including a pair of locking pliers, an adapter screw threaded into the locking pliers and including a threaded bore, an adjuster screw threaded into the threaded bore and configured to adjust the locking pliers, a cable lug having a ring portion positioned between the adapter screw and a jam nut, and a cable connected to the cable lug.

14 Claims, 5 Drawing Sheets

LOCKING TERMINAL CLAMP CABLE ASSEMBLY

CROSS-REFERENCE TO RELATED APPLICATIONS

This application claims priority to and the benefit of U.S. Provisional Application No. 62/331,532, filed May 4, 2016, the disclosure of which is hereby incorporated by reference in its entirety.

TECHNICAL FIELD

This patent application is directed to cable assemblies and, more specifically, to cable assemblies having locking terminal clamps.

BACKGROUND

Existing cable assemblies, such as jumper cables, include spring loaded clamps that are typically bulky and difficult to attach to standard and side-post battery terminals. Conventional cable clamps are therefore susceptible to becoming dislodged from battery terminals which can result in shorting of the battery. Accordingly, there is a need for improved cable assemblies.

BRIEF DESCRIPTION OF THE DRAWINGS

The locking terminal clamp cable assemblies introduced here may be better understood by referring to the following Detailed Description in conjunction with the accompanying drawings all of which are incorporated herein and constitute a part of this specification.

Figure 1:
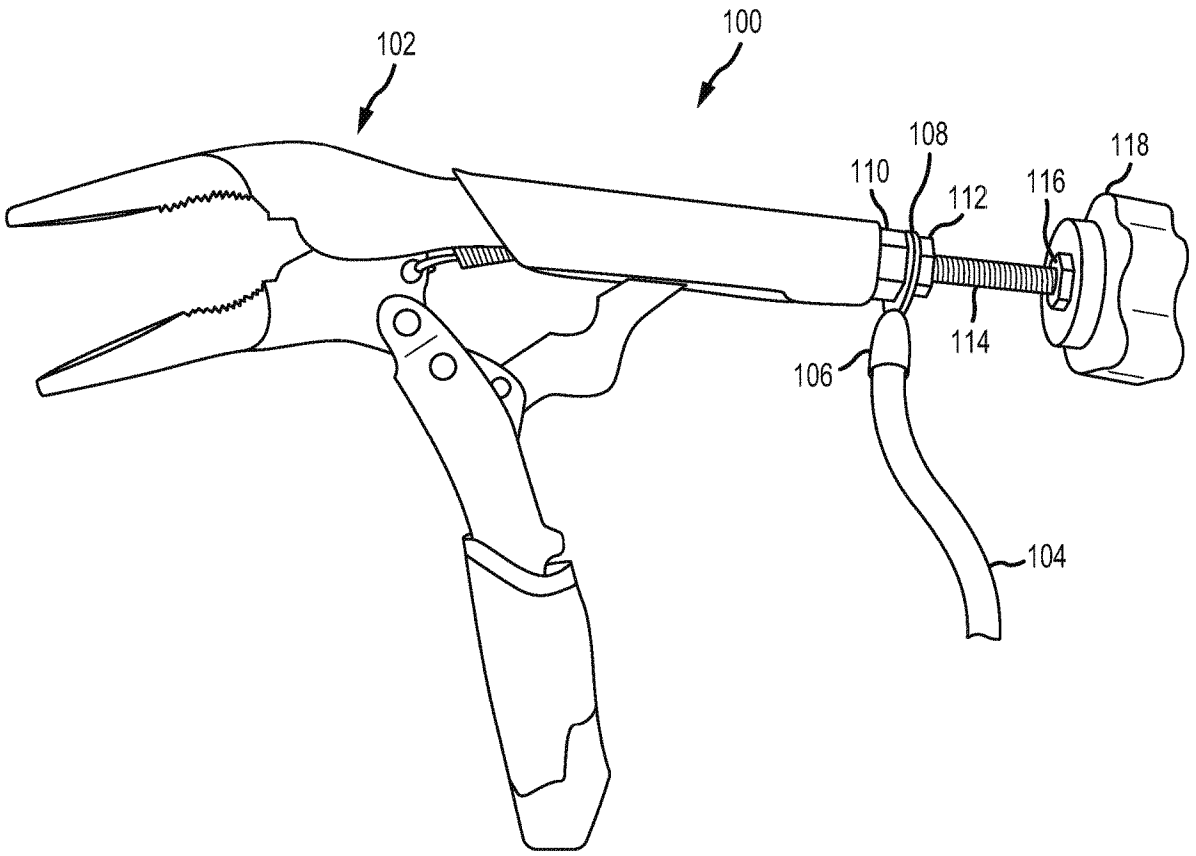
FIG. 1 is a side view of a locking terminal clamp cable assembly according to a representative embodiment.

The headings provided herein are for convenience only and do not necessarily affect the scope of the embodiments. Further, the drawings have not necessarily been drawn to scale. For example, the dimensions of some of the elements in the figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to limit the embodiments described. On the contrary, the embodiments are intended to cover all modifications, equivalents, and alternatives falling within the scope of this disclosure.

DETAILED DESCRIPTION

The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures or functions may not be shown or described in detail below so as to avoid unnecessarily obscuring the relevant description.

The terminology used below is to be interpreted in its broadest reasonable manner, even though it is being used in conjunction with a detailed description of some specific examples of the embodiments. Indeed, some terms may even be emphasized below; however, any terminology intended to be interpreted in any restricted manner will be overtly and specifically defined as such in this section.

Figure 4:
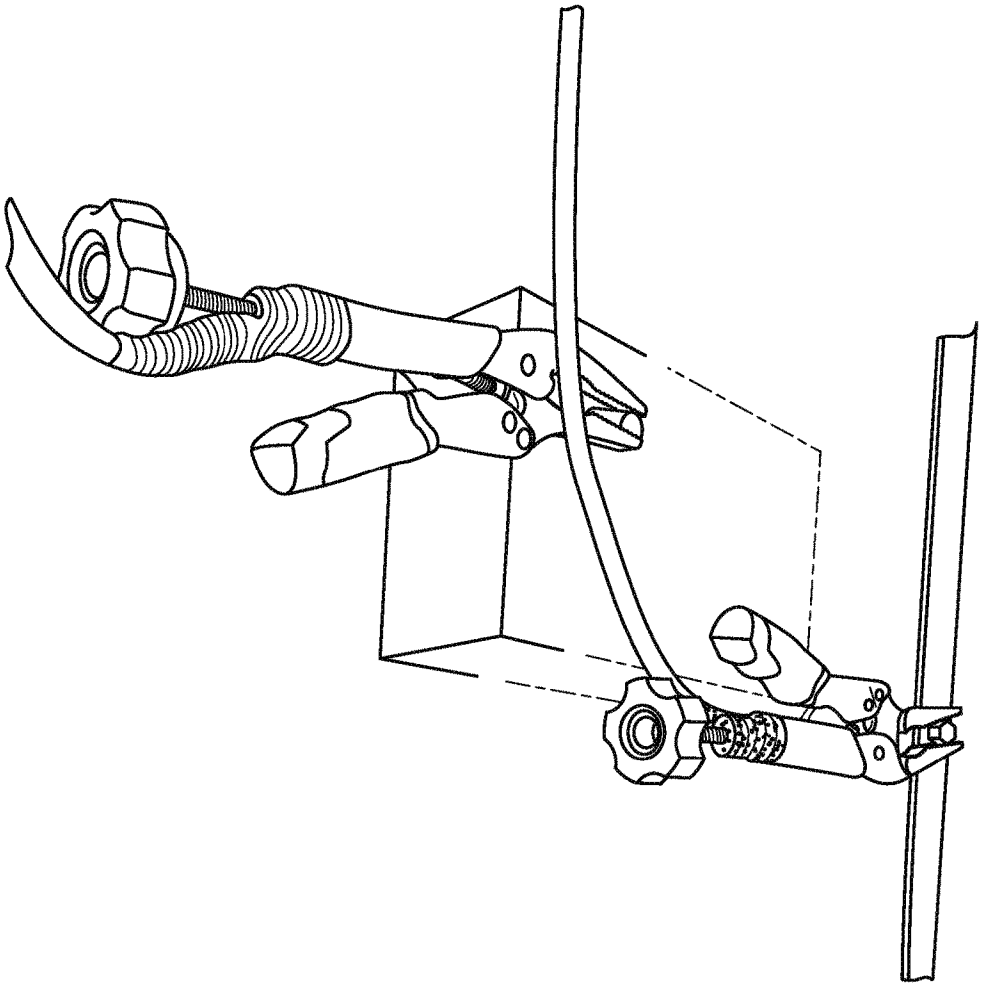
FIG. 4 illustrates the locking terminal clamp cable assembly attached to battery terminals and ground locations on a vehicle.

As shown in FIG. 1, the locking terminal clamp cable assembly 100 includes locking terminal clamp 102 with a cable 104 attached thereto. In some embodiments, the locking terminal clamp 102 comprises modified locking pliers. The cable is attached to the locking terminal clamp 102 with a cable lug 106 having a ring portion 108 that is positioned between adapter screw 110 and jam nut 112. Cable 104 can be soldered and/or crimped onto lug 106. Although only one locking terminal clamp 102 is shown in FIG. 1, the cable assembly 100 can include a second locking terminal clamp connected to the opposite end of cable 104. In some embodiments, insulation can be applied to the cable end portion attached to the locking terminal clamp cable assembly, such as shown in FIG. 4, for example. The insulation can be electrical tape, heat shrink material, or the like.

Figure 2:
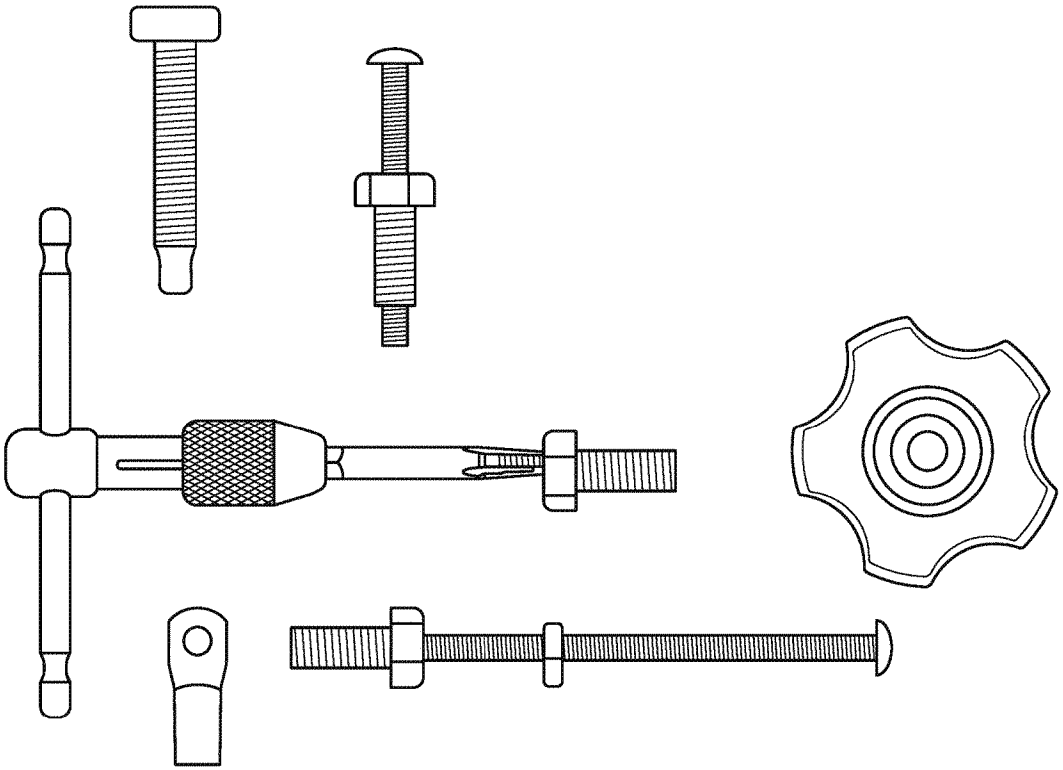
FIGS. 2-3 illustrate the various components of the locking terminal clamp cable assembly shown in FIG. 1.
Figure 3:
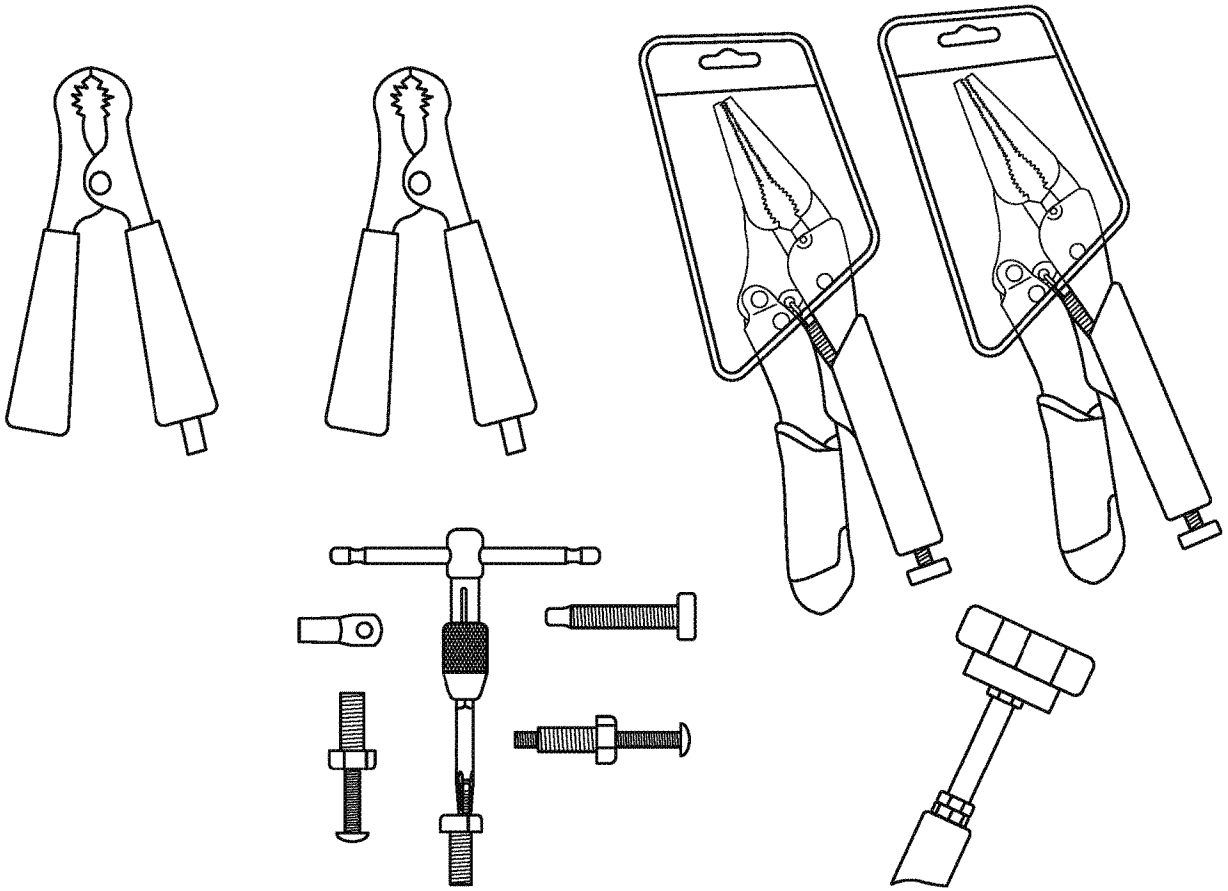

The adapter screw 110 replaces the adjustment screw typical on locking pliers (see FIG. 3 for example). The adapter screw 110 threads into the locking pliers and includes a threaded through bore that receives adjuster screw 114. Adjuster screw 114 provides the adjustment function of the original adjuster screw. With reference to FIG. 2, the adapter screw 110 can comprise a standard hex cap screw that is drilled and tapped to receive screw 114. It should be understood that the adapter screw 110 has the same threads as the original adjuster screw. Returning to FIG. 1, a knob 118 is attached to the adjustment screw 114 and locked in place with knob jam nut 116. Knob 118 can be conveniently grasped and turned to adjust the locking terminal clamp as necessary.

Figure 5:
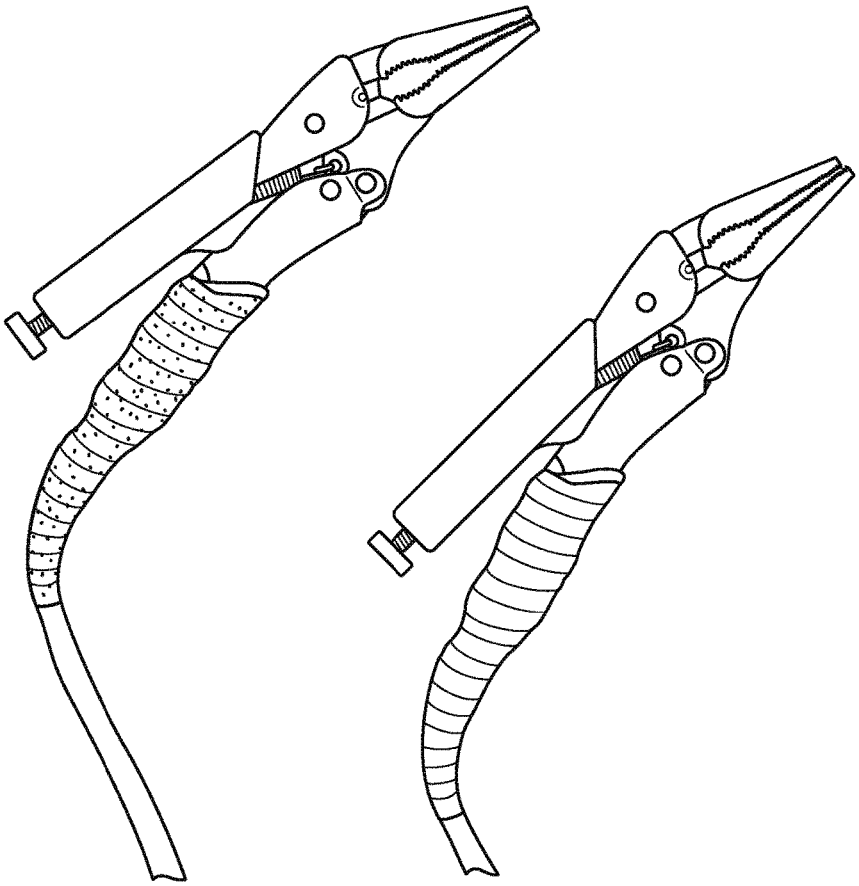
FIG. 5 illustrates a locking terminal clamp cable assembly according to another representative embodiment.

FIG. 5 illustrates another embodiment of a locking terminal clamp cable assembly. In the illustrated embodiment, the cable is attached to the locking pliers on the handle portion opposite the adjustment handle (i.e., the non-locking handle). In this embodiment, the locking pliers' adjustment screw remains functional.

Also disclosed herein are methods of modifying locking pliers and/or conventional jumper cables according to the disclosed technology. For example, the conventional spring clamps can be cut off of traditional jumper cables, as shown for example in FIG. 3, and replaced with the locking terminal clamp cable assemblies disclosed herein. It should also be understood that the locking terminal clamps can be adapted to other applications beyond jumper cables including for example and without limitation welding cables.

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not limited to various embodiments given in this specification. Unless otherwise defined, all technical and scientific terms used herein have the same meaning as commonly understood by one of ordinary skill in the art to which this disclosure pertains. In the case of conflict, the present document, including definitions, will control.

What is claimed is:

1. A locking terminal clamp cable assembly, comprising:
a pair of locking pliers;
an adapter screw threaded into the locking pliers and including a threaded bore;
an adjuster screw threaded into the threaded bore and configured to adjust the locking pliers;
a cable lug having a ring portion positioned between the adapter screw and a jam nut; and
a cable connected to the cable lug.

2. The locking terminal clamp cable assembly of claim 1, further comprising a knob attached to the adjuster screw.

3. The locking terminal clamp cable assembly of claim 1, further comprising insulation positioned around at least the adapter screw and cable lug.

4. The locking terminal clamp cable assembly of claim 1, further comprising a second pair of locking pliers connected to the cable.

5. A locking terminal clamp, comprising:
a pair of locking pliers, including:
a jaw with an elongate tapered configuration;
an electrically insulated palm grip; and
an electrically insulated finger grip;
an adapter screw threaded into the palm grip and including a threaded bore;
an adjuster screw threaded into the threaded bore and configured to adjust the locking pliers; and
a cable lug having a ring portion connected to the palm grip adjacent the adapter screw.

6. The locking terminal clamp of claim 5, further comprising insulation positioned around at least the adapter screw and cable lug.

7. The locking terminal clamp of claim 5, further comprising a knob attached to the adjuster screw.

8. The locking terminal clamp of claim 7, further comprising a knob jam nut positioned on the adjuster screw to lock the knob in position.

9. A locking terminal clamp cable assembly, comprising:
a pair of locking pliers, including:
a jaw;
a palm grip; and
a finger grip;
an adjuster screw extending into the palm grip and configured to adjust the locking pliers;
an adapter screw threaded into the palm grip and including a threaded bore configured to receive the adjuster screw;
a cable lug having a ring portion fastened to one of the palm grip or the finger grip; and
a cable connected to the cable lug.

10. The locking terminal clamp cable assembly of claim 9, further comprising a knob attached to the adjuster screw.

11. The locking terminal clamp cable assembly of claim 9, further comprising at least one lug bolt positioned to fasten the ring portion to the finger grip.

12. The locking terminal clamp cable assembly of claim 11, further comprising insulation positioned around at least the lug bolt and cable lug.

13. The locking terminal clamp cable assembly of claim 9, wherein the ring portion is connected to the palm grip adjacent the adapter screw.

14. The locking terminal clamp cable assembly of claim 13, further comprising insulation positioned around at least the adapter screw and cable lug.

* * * * *